US005743441A

United States Patent [19]

Baudin et al.

[11] Patent Number: 5,743,441

[45] Date of Patent: Apr. 28, 1998

[54] DEVICE FOR PACKAGING AND DISPENSING A LIQUID, A GEL, OR A PASTE, AND HAVING A DOME-SHAPED APPLICATOR

[75] Inventors: Gilles Baudin, Eragny; Nicolas Albisetti, Sevran, both of France

[73] Assignee: L'Oreal, Paris, France

[21] Appl. No.: 668,745

[22] Filed: Jun. 24, 1996

[30] Foreign Application Priority Data

Jul. 10, 1995 [FR] France ..... 95 08305

[51] Int. Cl.[6] ..... B65D 37/00

[52] U.S. Cl. ..... 222/212; 222/206; 222/494

[58] Field of Search ..... 222/212, 491, 222/494, 206, 213

[56] References Cited

U.S. PATENT DOCUMENTS

| | | | |
|---|---|---|---|
| 3,674,183 | 7/1972 | Venable et al. | 222/212 |
| 4,646,945 | 3/1987 | Steiner et al. | 222/212 |
| 4,699,300 | 10/1987 | Blake | 222/494 |
| 4,739,906 | 4/1988 | LoTurco | 222/212 |
| 4,846,810 | 7/1989 | Gerber | 222/212 |

FOREIGN PATENT DOCUMENTS

| | | |
|---|---|---|
| C-447 237 | 7/1927 | Germany . |
| U-92 00 245 | 6/1992 | Germany . |
| A-528 415 | 11/1972 | Switzerland . |

*Primary Examiner*—J. Casimer Jacyna
*Attorney, Agent, or Firm*—Oliff & Berridge, PLC

[57] ABSTRACT

A device for packaging and dispensing a substance in the form of a liquid, a gel, or a paste, e.g. a cosmetic, comprises a reservoir and a dome-shaped applicator communicating internally with the reservoir and provided with outlet orifices, with the substance being caused to flow through the outlet orifices by being subjected to pressure upstream therefrom. The applicator includes an elastic outer membrane pierced by substance-dispensing orifices and an inner supporting wall having feed orifices that are offset from the dispensing orifices so that when the outer membrane is at rest it isolates the feed orifices from the outside, the outer membrane being capable of moving elastically away from the inner supporting wall under the effect of dispensing pressure being applied to the substance so as to enable the substance to flow out therethrough.

11 Claims, 3 Drawing Sheets

DEVICE FOR PACKAGING AND DISPENSING A LIQUID, A GEL, OR A PASTE, AND HAVING A DOME-SHAPED APPLICATOR

The present invention relates to a device for packaging and dispensing a substance in liquid, gel, or paste form, such as a cosmetic, the device comprising both a reservoir suitable for containing said substance and suitable for being put under pressure to dispense the substance, and a dome-shaped applicator communicating internally with said reservoir and provided with outlet orifices through which the substance is dispensed. The substance is caused to flow through said outlet orifices by being put under pressure upstream therefrom.

BACKGROUND OF THE INVENTION

With known devices of that type, after each use, it is necessary to replace a closure lid on the applicator for the purpose of isolating the outlet orifices from ambient air and preventing the substance from drying or deteriorating.

OBJECTS AND SUMMARY OF THE INVENTION

An object of the present invention is to provide a novel device that is easier to use and that makes it possible in particular to avoid having to replace a closure lid on the applicator every time and immediately after the substance has been applied, while nevertheless ensuring that the substance is properly conserved.

The invention achieves this object by the fact that the dome-shaped applicator includes an elastic outer membrane for applying the substance to a large surface such as the skin, with substance-dispensing orifices passing therethrough, and an inner supporting wall on which said membrane rests in the absence of said product being put under pressure for the purpose of being dispensed, the inner supporting wall having feed orifices that are offset relative from said dispensing orifices such that, when the outer membrane is at rest, it isolates said feed orifices from the outside, the outer membrane also being capable of moving elastically away from said inner supporting wall under the effect of pressure applied to the substance for the purpose of dispensing it, thereby allowing said substance to flow from the feed orifices towards said dispensing orifices and allowing the substance to move out from the applicator.

In a particular embodiment of the invention, the membrane is fixed on said inner supporting wall at multiple fixing points, which fixing points are distributed over said inner supporting wall in such a manner as to channel the flow of substance leaving said feed orifices towards said dispensing orifices for the purpose of avoiding stagnation of the substance between the outer membrane and the inner supporting wall when the device is not in use.

In a particular embodiment of the invention, the supporting wall includes openings with ridges of material passing therethrough and secured to said outer membrane for the purpose of securing it to said fixing points.

The outer membrane may be made of EVA, of flexible PVC, of a copolymer of thermoplastic polyurethane, a propylene-ethylene copolymer, or a thermoplastic elastomer obtained by physically mixing together a thermoplastic and a vulcanized or non-vulcanized elastomer.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

Figure 1:
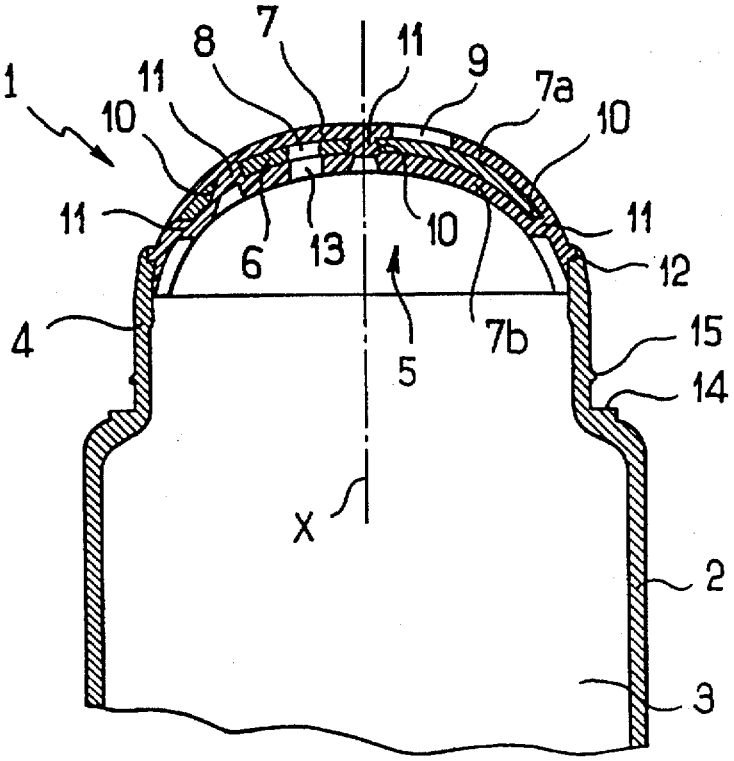
FIG. 1 is a diagrammatic and fragmentary axial section through a packaging and dispensing device constituting a first embodiment of the invention.

FIG. 1 shows a fragment of a packaging and dispensing device of the invention.

The device 1 in the example described is in the general form of a tube, with only the top portion being shown.

The tube has a tubular wall 2 whose inside defines a reservoir 3 for the substance to be packaged and dispensed, and which is provided at one end with a dispensing neck 4, advantageously integrally molded with the tubular wall 2. The wall is flexible so as to allow the user to squeeze the tube to dispense the substance.

A dome-shaped applicator 5 is fitted to the mouth of the neck 4. The applicator 5 has an inner wall 6 of rigid or semirigid plastics material, supporting an outer membrane 7 of flexible and elastic plastics material, e.g. elastomer.

The inner supporting wall 6 may be integrally molded with the neck 4, or in a variant it may be made separate and fixed directly or indirectly on the neck 4 by welding or by snap-fastening.

The inner supporting wall 6 is generally outwardly convex, i.e. away from the reservoir 3, which is upwards in FIG. 1. More precisely, in the example described, the inner wall 6 is in the form of a generally ellipsoidal or spherical cap, centered on the axis X which is generally longitudinal relative to the tube and which constitutes an axis of symmetry for the neck 4.

When at rest, the membrane 7 is substantially the same shape and size as the inner wall 6 that supports it, and it has a curved outside surface which imparts a dome shape to the applicator when seen from the outside. Naturally, it would not go beyond the ambit of the invention to modify the shape of the applicator 5, e.g. by flattening the top thereof or by making a depression therein.

In accordance with the invention, the inner wall 6 is pierced by feed orifices 8, and the outer membrane 7 is pierced by dispensing orifices 9. The inner wall 6 also has openings 10 for securing the membrane 7.

In the example described, the membrane 7 is molded over the inner wall 6 which acts as a support, and it has both an outer portion **7*a* and an inner portion 7*b* situated respectively in contact with the outside face and with the inside face of the supporting wall 6. The outer and inner portions 7*a* and 7*b* are interconnected by bridges of material 11 passing through the openings 10**. The periphery of the outer portion 7*a* has a shouldered edge 12 welded in leakproof manner to the top end of the neck 4. The inner portion 7*b* has openings 13 situated in register with the feed orifices 8 of the inner wall 6 so as to cause said orifices to communicate with the inside of the reservoir 3.

In accordance with the invention, the feed orifices 8 and the dispensing orifices 9 are offset so that the feed orifices 8 are normally closed by the outer portion 7*a* of the membrane 7 when the membrane is at rest, i.e. when no pressure is being exerted on the tube to dispense the substance.

Figure 2:
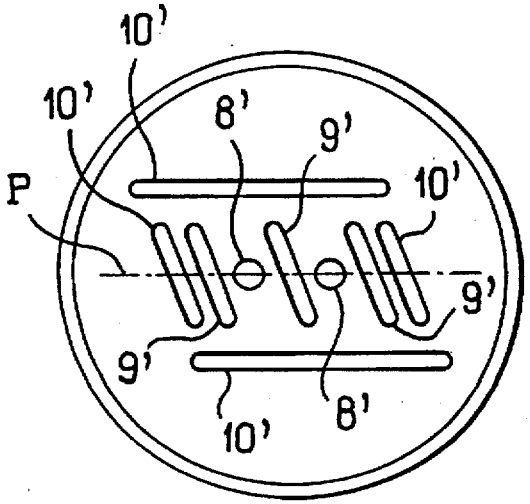
FIGS. 2 and 3 are plan views of two variant embodiments of a dome-shaped applicator of the invention.
Figure 3:
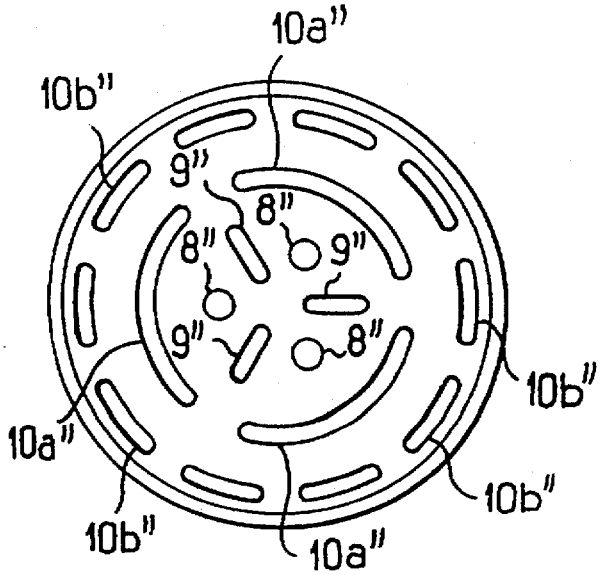
Figure 4:
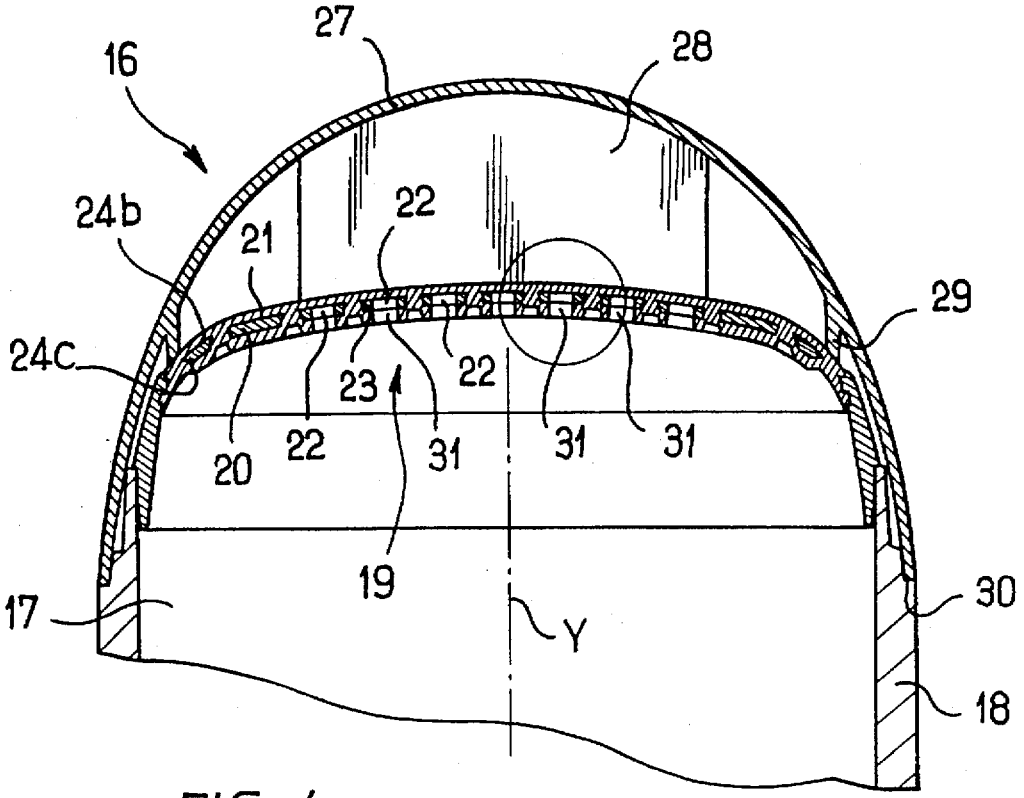
FIG. 4 is a diagrammatic and fragmentary axial section of a packaging and dispensing device constituting a second embodiment of the invention.
Figure 5:
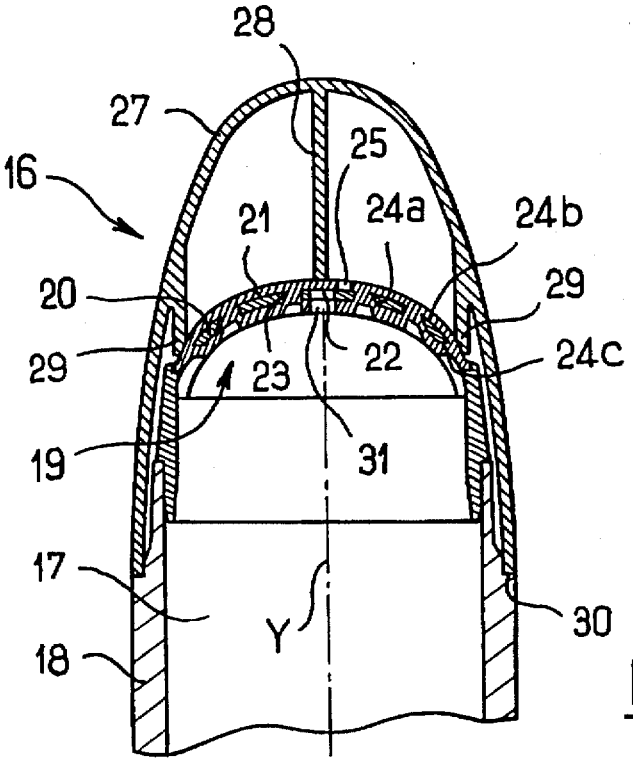
FIG. 5 is a section on a plane perpendicular to that of FIG. 4.

FIGS. 2 and 3 are plan views, i.e. they are projections onto a plane perpendicular to the axis X, and they show two examples of how the feed and dispensing orifices can be distributed over the dome-shaped applicator.

In the example of FIG. 2, the inner supporting wall is pierced in the vicinity of its apex by two feed orifices 8' that are circular. The outer membrane is pierced by three dispensing orifices 9' in the form of oblong slots having mutually parallel longitudinal axes inclined relative to the plane P interconnecting the axes of the two orifices 8'. Each feed orifice 8' is located between two dispensing orifices 9'. Four openings 10' are parallel in pairs and are disposed along the sides of a parallelogram surrounding the three dispensing orifices 9', and these openings are made through the inner wall for the purpose of fixing the membrane thereto. The openings 10' are in the form of oblong slots, two of which are identical to shape to the dispensing orifices 9' and are parallel thereto.

In the example of FIG. 3, the supporting wall is pierced close to its apex by three feed orifices 8" that are circular and uniformly distributed angularly about the axis X. Three dispensing orifices 9" are provided through the outer membrane between the feed orifices 8". The dispensing orifices 9" are uniformly distributed angularly around the axis X and each is in the form of an oblong slot whose longitudinal axis extends radially. Openings serve to secure the outer membrane to the supporting inner wall. In the example described, these Openings are in the form of a first row of three arcuate slots 10*a*" centered on the axis of the applicator and each lying in the angle formed between the longitudinal axes of two of the dispensing orifices 9", together with a second row of ten arcuate slots 10*b*" formed through the periphery of the supporting wall.

The operation of the device 1 is described below with reference to FIG. 1.

When the device is not in use, the outer portion 7*a* of the membrane 7 rests on the outer face of the supporting wall 6 which serves as a seat therefor and which isolates the feed orifices 8 from ambient air. When the substance contained in the reservoir 8 is put under pressure in order to be dispensed, which is done in the present example by reducing the inside volume of the reservoir by squeezing the tube, then those portions of the outer membrane 7 that are in register with the feed orifices 8 are lifted by the substance-dispensing pressure, thereby enabling the substance to flow away from the feed orifices 8 so as to reach the dispensing orifices 9 and thus be dispensed to the outside of the applicator 5.

The points where the outer portion 7*a* of the membrane 7 is secured are far enough away from the feed orifices 8 and from the dispensing orifices 9 to enable the outer portion 7*a*of the membrane 7 to move elastically away from the supporting wall 6 so as to allow the substance to be dispensed to pass through.

When the user releases pressure on the tube, the outer portion 7*a* of the membrane 7 returns elastically to rest against the supporting wall 6, thereby again insulating the feed orifices 8 so as to ensure that the substance contained in the reservoir 3 is properly conserved.

The substance that has flowed through the dispensing orifices 9 while pressure was being exerted on the tube now rests on the outside surface of the membrane 7 ready to be applied over a large area such as the skin of the user.

The membrane 7 is preferably made of an elastomer material which gives a soft feel to the user. The membrane can thus be made out of an olefin thermoplastic elastomer such as a PP/EPDM mixture, or out of a vulcanized elastomer such as a PP/NBR mixture, or out of a block copolymer elastomer, such as a thermoplastic polyurethane, or indeed out of a semi-crystalline thermoplastic of the EVA type, for example.

When the membrane 7 is molded over the support 6, the respective materials thereof must be selected so that they do not adhere one on the other.

It will be observed in the example described that the feed orifices 8 are isolated from the outside when the membrane 7 is resting in the absence of any substance-dispensing pressure acting on the supporting wall 6, and there is therefore no need to provide said wall with closure spikes projecting from its outside surface and shaped to engage in the dispensing orifices 9. As a result the dispensing orifices 9 are free and the outside surface of the supporting wall 6 does not include any projections of rigid plastics material engaged in the dispensing orifices and liable to feel uncomfortable when a user presses the applicator against the skin.

In the example described, it will also be observed that the dispensing orifices 9 are permanently open and as a result there is no danger of substance accumulating in the gap between the outside surface of the supporting wall 6 and the inside surface of the outer portion 7*a* of the membrane 7 after the user has released the pressure exerted on the tube. Such an accumulation of substance could impede use, e.g. by giving rise to an uncontrolled jet of substance when the user presses the applicator against the skin. The dispensing orifices are distributed in a manner chosen by the person skilled in the art as a function of the area to be covered during application.

A closure lid (not shown in the figures) may advantageously be placed on the applicator 5 while the device 1 is not in use. The lid is shaped to be engaged on the neck 4 so as to come into abutment against the shoulder 14 via which the neck 4 connects with the tubular wall 2.

The outside surface of the neck 4 has an annular projection 15 and the closure lid has an annular groove of complementary shape that snaps onto said projection when the lid is properly inserted on the neck 4. The lid advantageously includes webs in the end thereof that are shaped to bear against the apex of the membrane 7, thereby preventing it from lifting and allowing substance to be dispensed in the event of the tube being squeezed accidentally, while the lid is in place.

FIGS. 4 to 8 show another embodiment of a packaging and dispensing device 16 of the invention.

Figure 7:
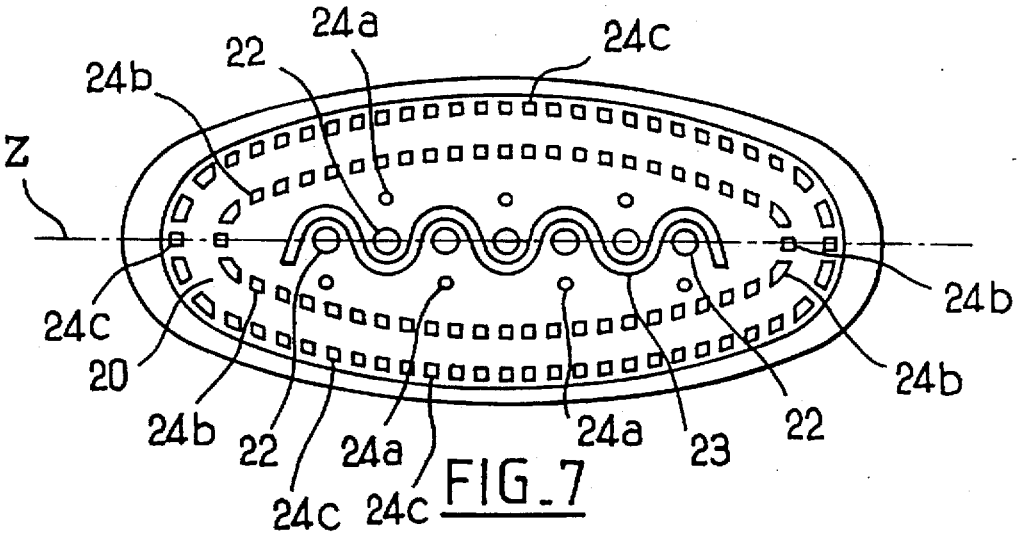
FIG. 7 is a plan view of the inner supporting wall corresponding to the device shown in FIG. 4, the outer membrane being removed.
Figure 8:
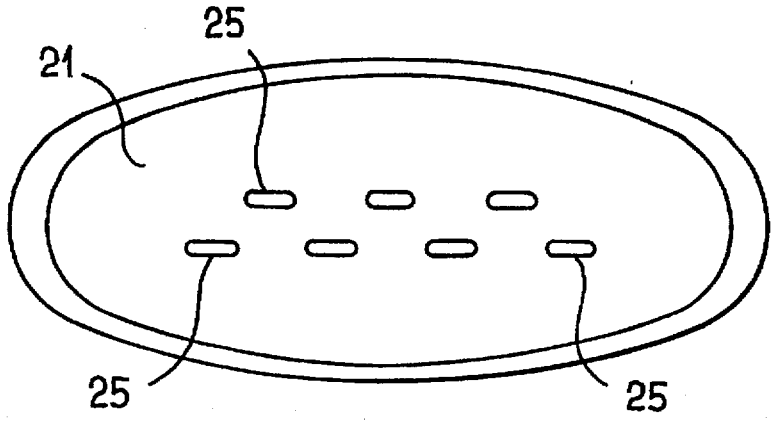
FIG. 8 is a plan view of the outer membrane fitted to the device shown in FIG. 4.

The device 16 comprises a reservoir 17 suitable for containing a substance to be packaged and dispensed, and defined laterally by a tubular wall 18 which is elongate along a axis Y and closed at one end by a dome-shaped applicator 19. The applicator 19 has an inner supporting wall 20 of rigid or semirigid plastics material and an outer membrane 21 of elastomer material. The supporting wall 20, shown on its own in plan view in FIG. 7, has a shape that is oval, being elongate along a longitudinal axis Z, and it is pierced through its apex by a row of seven uniformly spaced-apart circular feed orifices 22 whose axes all lie in a common midplane containing the axes Y and Z. An opening 23 follows a sinuous path between the feed orifices 22, as shown in FIG. 7.

A first series of openings 24*a* is formed on either side of the row of feed orifices 22 for securing the membrane 21 on the supporting wall 20. More precisely, the openings 24*a* are circular in section, each being located close to a feed orifice 22 and being on the side thereof opposite to the adjacent portion of the opening 23. Each plane containing the axes of an opening 24*a* and the associated feed orifice 22 extends perpendicularly to the longitudinal axis Z. A second series of openings 24*b* is provided around the feed orifices 22 and the openings 24*a*. This second series of openings 24*b* extends, in plane view, around an oval line that is geometrically similar to the outline of the supporting wall 20. A third series of openings 24*c* is provided at the periphery of the supporting wall and extends around a line that is geometrically similar to that around which the second series of openings 24*b* extends. A series of seven dispensing orifices 25 is formed through the membrane 21. Each dispensing orifice 25 is in the form of an oblong slot whose axis is parallel to the axis Z and which is situated between a feed orifice 22 and the associated opening 24*a*.

Figure 6:
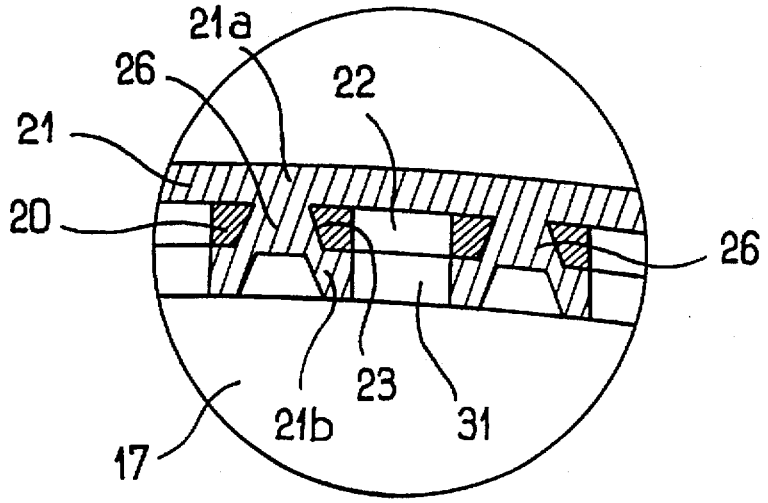
FIG. 6 is a view on a larger scale of a detail of the embodiment of the device shown in FIG. 4.

The openings 23, 24*a*, 24*b*, or 24*c* formed through the supporting wall 20 for securing the membrane 21 are preferably of a section that tapers outwardly, as shown in FIG. 6. In the example described, the angle formed between two opposite converging edges of an opening is 40°. The membrane 21 includes an outer portion 21*a* with the dispensing orifices 25 passing therethrough and an inner portion 21*b* for holding against the supporting wall 20. The outer and inner portions 21*a* and 21*b* are connected together by bridges of material 26 extending through openings formed through the supporting wall 20. The inner portion 21*b* bears against the inside surface of the supporting wall 20 to hold the outer portion 21*a* of the membrane 21.

A closure lid 27 may advantageously be fitted to the applicator 19 so as to cover the membrane 21 whenever the device 16 is not in use for an extended period of time. The lid 27 advantageously includes webs integrally molded therewith out of the same plastics material as the remainder of the lid 27 and suitable for having their free edges bear against the outside surface of the membrane 21 so as to hold the membrane pressed down against the supporting wall 20 when the device is not in use. In the example described, the lid 27 has a plane central web 28 that is parallel to the midplane containing the axes Y and Z and pressing against the apex of the membrane 21 over the row of feed orifices 22, together with a web 29 that presses down against the periphery of the membrane 21.

The lid 27 is shaped so as to be held by friction on the wall 18 of the reservoir 17. The periphery thereof has a shoulder 30 for acting as an end-of-stroke abutment for insertion of the lid 27.

In the example described, the supporting wall 20 is engaged on the top end of the wall 18. In a variant, the supporting wall 20 could be integrally molded with the wall 18 of the reservoir 17. The membrane 21 is molded onto the supporting wall 20.

In the example described, the substance is put under pressure in order to be dispensed in conventional manner by means of a piston (not shown) that is guided to slide relative to the wall 18 of the reservoir 17 and that is screwed on a threaded drive shaft provided at one end with a drive knob.

The device 16 described with reference to FIGS. 4 to 8 operates as follows.

To dispense the substance, the user removes the lid 27 and turns the above-mentioned drive knob to reduce the inside volume of the reservoir 17 and put the substance contained therein under pressure. The pressure for dispensing the substance through the feed orifices 22 locally pushes away the outer portion 21*a* of the membrane 21, thereby allowing the substance to flow between the feed orifices 22 and the dispensing orifices 25. The inner portion 21*b* of the membrane 21 has openings in register with the feed orifices 22 so as to enable the substance to penetrate therein. The opening 23 which is semicircular in shape in the vicinity of each feed orifice 22 with the concave side thereof being directed towards the associated dispensing orifice 25 channels the substance leaving via said feed orifice 22, forcing it to go towards the associated dispensing orifice 25.

This prevents substance stagnating in the gap between the inside surface of the outer portion 21*a* of the membrane 21 and the outside surface of the supporting wall 20, while nevertheless ensuring effective holding of the membrane on the support by means of the positioning of the openings 24*a*, 24*b*, and 24*c*, thus preventing the membrane from being torn off even though it is fragile, given the nature of the material used for making it. The same advantages are provided as in the embodiments described above with reference to FIGS. 1 to 3.

When the user has finished turning the drive knob, the substance to be applied lies on the outside surface of the membrane 21. Because of its elastic properties and because of its multiple attachment points to the supporting wall 20, the membrane returns to its initial shape and again rests entirely on the supporting wall 20 so as to close the feed orifices 22 and isolate the inside of the reservoir 17 from ambient air.

Naturally, the invention is not limited to the embodiments described above. In particular, a dome-shaped applicator of the invention can be fitted to any device in which a substance is put under pressure for dispensing purposes, either by applying pressure to a flexible wall defining the reservoir, or by means of a screw and piston mechanism, or else by means of a pump.

What is claimed is:

1. A device for packaging and dispensing a substance selected from the group consisting of a liquid, a gel, or a paste, the device comprising both a reservoir suitable for containing said substance and suitable for being put under pressure to dispense said substance, and a dome-shaped applicator communicating internally with said reservoir and provided with a plurality of outlet orifices for the substance to be dispensed, the substance being caused to flow through at least one of the plurality of outlet orifices by applying pressure to the substance upstream from said plurality of outlet orifices, wherein the applicator includes an elastic outer member adapted for applying the substance to a large surface of the skin, with a plurality of substance-dispensing orifices passing therethrough, and a dome-shaped inner supporting wall on which said membrane rests in the absence of said product being put under pressure for the purpose of being dispensed, the inner supporting wall having a plurality of feed orifices that are offset relative from said plurality of dispensing orifices such that, when the outer membrane is at rest, it isolates said plurality of feed orifices from the outside, the outer membrane also being capable of moving elastically away from said inner supporting wall under the effect of pressure applied to the substance for the purpose of dispensing it, thereby allowing said substance to flow from the plurality of feed orifices towards said plurality of dispensing orifices and allowing the substance to move out from the applicator.

2. A device according to claim 1, wherein the membrane is fixed on said inner supporting wall at multiple fixing points, which fixing points are distributed over said inner supporting wall in such a manner as to channel the flow of substance leaving said plurality of feed orifices towards said plurality of dispensing orifices for the purpose of avoiding stagnation of the substance between the outer membrane and the inner supporting wall when the device is not in use.

3. A device according to claim 2, wherein the supporting wall includes a plurality of openings with ridges of material of said outer membrane passing therethrough, said ridges securing the outer membrane to said multiple fixing points.

4. A device according to claim 1, wherein said membrane is overmolded on said inner supporting wall.

5. A device according to claim 1, wherein said inner wall is integrally molded with the wall of the reservoir.

6. A device according to claim 1, wherein each of said plurality of feed orifices has an axis and wherein the axes of the plurality of feed orifices are aligned in a single plane.

7. A device according to claim 1, wherein said plurality of feed orifices are uniformly distributed, angularly.

8. A device according to claim 1, wherein said plurality of feed orifices are circular in section, and wherein said plurality of dispensing orifices are in the form of a plurality of oblong slots.

9. A device according to claim 1, wherein said plurality of dispensing orifices are in the form of oblong a plurality of slots having longitudinal axes extending perpendicularly to the displacement direction of the membrane during use of the device to apply the substance.

10. A device according to claim 1, wherein said outer membrane is made of a material selected from the following list: EVA; flexible PVC; a thermoplastic polyurethane copolymer; a propylene-ethylene copolymer; and a thermoplastic elastomer obtained by physically mixing a thermoplastic and a vulcanized or non-vulcanized elastomer.

11. A device for packaging and dispensing a substance selected from the group consisting of a liquid, a gel, or a paste, such as a cosmetic, the device comprising both a reservoir suitable for containing said substance and suitable for being put under pressure to dispense said substance, and a dome-shaped applicator communicating internally with said reservoir and provided with outlet orifices for the substance to be dispensed, the substance being caused to flow through said outlet orifices by applying pressure to the substance upstream from said orifices, wherein the applicator includes an elastic outer membrane adapted for applying the substance to a large surface of the skin, with substance-dispensing orifices passing therethrough, and a dome-shaped inner supporting wall on which said membrane rests in the absence of said product being put under pressure for the purpose of being dispensed, the inner supporting wall having feed orifices that are offset relative from said dispensing orifices such that when the outer membrane is at rest, it isolates said feed orifices from the outside, the outer membrane also being capable of moving elastically away from said inner supporting wall under the effect of pressure applied to the substance for the purpose of dispensing it, thereby allowing said substance to flow from the feed orifices towards said dispensing orifices and allowing the substance to move out from the applicator, wherein the membrane is fixed on said inner supporting wall at multiple fixing points, which fixing points are distributed over said inner supporting wall in such a manner as to channel the flow of substance leaving said feed orifices towards said dispensing orifices for the purpose of avoiding stagnation of the substance between the outer membrane and the inner supporting wall when the device is not in use, wherein the supporting wall includes openings with ridges of material of said outer membrane passing therethrough, said ridges securing the outer membrane to said multiple fixing points.

* * * * *